US006203336B1

(12) United States Patent
Nakamura

(10) Patent No.: US 6,203,336 B1
(45) Date of Patent: Mar. 20, 2001

(54) SOCKET-TYPE MULTIPOLAR ELECTRICAL CONNECTOR

(75) Inventor: Masahiko Nakamura, Yao (JP)

(73) Assignee: Hosiden Corporation, Osaka-fu (JP)

( * ) Notice: Subject to any disclaimer, the term of this patent is extended or adjusted under 35 U.S.C. 154(b) by 1299 days.

(21) Appl. No.: 08/534,100

(22) Filed: Sep. 26, 1995

Related U.S. Application Data

(63) Continuation of application No. 08/295,057, filed on Aug. 26, 1999, now abandoned, which is a continuation of application No. 08/022,319, filed on Feb. 25, 1993, now abandoned.

(30) Foreign Application Priority Data

Dec. 11, 1992 (JP) ..... 4-085328 U

(51) Int. Cl.[7] ..... H01R 13/648; H01R 12/00
(52) U.S. Cl. ..... 439/80; 439/607; 439/747
(58) Field of Search ..... 439/79, 80, 607, 439/682, 747, 381, 856, 352, 353, 354

(56) References Cited

U.S. PATENT DOCUMENTS 2,879,491 * 3/1959 Shapiro ..... 439/637
3,864,000 * 2/1975 Coller et al. ..... 439/79
4,582,386 * 4/1986 Martens ..... 439/631
5,013,262 * 5/1991 Shibano ..... 439/610
5,017,156 * 5/1991 Sugiyama ..... 439/607
5,055,069 * 10/1991 Townsend et al. ..... 439/80
5,171,161 * 12/1992 Kachlic ..... 439/607
5,190,480 * 3/1993 Chau et al. ..... 439/637
5,281,165 * 1/1994 McCleerey et al. ..... 439/510

FOREIGN PATENT DOCUMENTS

2186748 * 8/1987 (GB) ..... 439/752

* cited by examiner

*Primary Examiner*—Neil Abrams
(74) *Attorney, Agent, or Firm*—Jones, Tullar & Cooper, P.C.

(57) ABSTRACT

In a socket-type multipolar electrical connector to be used together with a plug-type multipolar electrical connector as its counter connector, a body has first contact-piece holding holes with the horizontal pitch P1 between each adjacent holding holes being fine, and second contact-piece holding holes with the horizontal pitch P2 between each adjacent holding holes being coarse. Contact pieces are fitted in and held by the first and second contact-piece holding holes. The assembly pattern in which the contact pieces are arranged, is similar to the assembly pattern of terminals respectively extending from the contact pieces. The body and the contact pieces are surrounded by a shield cover.

15 Claims, 16 Drawing Sheets

SOCKET-TYPE MULTIPOLAR ELECTRICAL CONNECTOR

This application corresponds to prior, commonly owned application, Ser. No. 08/022,318, filed Feb. 25, 1993, which has been assigned U.S. Pat. No. 5,338,227, and is a continuation of application, Ser. No. 08/295,057, filed Aug. 26, 1994, now abandoned, which is a continuation of application, Ser. No. 08/022,319, filed Feb. 25, 1993, also now abandoned.

BACKGROUND OF THE INVENTION

1. Field of the Invention

The present invention relates to a socket-type multipolar electrical connector to be used together with its counter connector or plug-type multipolar electrical connector, and more particularly to a socket-type multipolar electrical connector in which, without hindrance for various types of signal processings, the pitch between each adjacent contact piece of a plurality of contact pieces is minimized to miniaturize the connector with the density of the contact pieces increased, so that the connector can be mounted directly on a printed circuit board.

2. Description of the Prior Art

When a socket-type multipolar electrical connector is used together with its counter connector or plug-type multipolar electrical connector in which all the terminal pins are arranged in a predetermined assembly pattern with a high density, the socket-type multipolar electrical connector is such that all the contact pieces thereof corresponding to the terminal pins are also arranged in the same assembly pattern with a high density.

There is conventionally known a socket-type multipolar electrical connector capable of satisfying the requirement mentioned above, which has contact piece groups comprising a plurality of contact pieces all of which are assembled with the body of the connector with the horizontal pitch between each adjacent contact piece being fine.

On the other hand, it is recently required to execute a variety of signal processings using a composite cable in which a braided shell shield surrounds various types of conductors (core wires, twisted wires and the like) having different diameters.

When a plug-type multipolar electrical connector is used satisfying the requirement mentioned above, i.e., an electrical connector of the type mentioned earlier in which all the terminal pins are arranged in a predetermined assembly pattern with high density, a problem arises in that it becomes difficult to provide the space necessary for connecting (by soldering or calking) the respective conductors of the composite cable to the respective terminal pins. The same problem also resides in a socket-type multipolar electrical connector.

There is known the technique discussed in Japanese Utility Model Application No. 4-15664, which corresponds to copending commonly owned copending application, Ser. No. 08/022,318, filed Feb. 23, 1993. This technique relates to a plug-type multipolar electrical connector which facilitates the wire handling of connecting the respective conductors having different diameters of a composite cable to respective terminal pins, yet enabling the electrical connector to be miniaturized with the density of the terminal pins increased. More specifically, this plug-type multipolar electrical connector is arranged such that the terminal pins are divided into a terminal pin group for thin conductors and a terminal pin group for thick conductors, the horizontal pitch between each adjacent terminal pin of the terminal pin group for thin conductors is fine, the horizontal pitch between each adjacent terminal pin of the terminal pin group for thick conductors is coarse. The terminal pin group for thin conductors is disposed at the center of the body made of an insulating material, and the terminal pin group for thick conductors is disposed at a lateral side of the terminal pin group for thin conductors.

SUMMARY OF THE INVENTION

The present invention is proposed in view of the foregoing.

It is an object of the present invention to provide a socket-type multipolar electrical connector which can be used together with, as its counter connector, a plug-type multipolar electrical connector as shown in Japanese Utility Model Application No. 4-15664 which comprises a terminal pin group for thin conductors in which the horizontal pitch between each adjacent terminal pin is fine, and a terminal pin group for thick conductors in which the horizontal pitch between each adjacent terminal pin is coarse, the terminal pin group for thick conductors being disposed at a lateral side of the terminal pin group for thin conductors.

It is another object of the present invention to provide a socket-type multipolar electrical connector which is effectively restrained from being increased in size to meet the demand for a miniaturized connector.

It is a further object of the present invention to provide a socket-type multipolar electrical connector having an excellent shielding function as an anti-noise (electrical noise) measure.

It is still another object of the present invention to provide a socket-type multipolar electrical connector excellent in maneuverability of attaching to and removing from its counter connector or plug-type multipolar electrical connector and also excellent in preventing the socket-type multipolar electrical connector attached to its counter connector from being unexpectedly disconnected therefrom.

To achieve the objects mentioned above, the present invention provides a socket-type multipolar electrical connector having a body made of an insulating material in which contact piece groups having a plurality of contact pieces are assembled. This socket-type multipolar electrical connector is characterized in that the contact piece groups comprise: a first contact piece group including a plurality of first contact pieces which are disposed in the body at the center thereof with the horizontal pitch between each adjacent contact piece being fine; and a second contact piece group including a plurality of second contact pieces which are disposed in the body at a lateral side of the first contact piece group with the horizontal pitch between each adjacent contact piece being coarse.

According to the socket-type multipolar electrical connector having the arrangement mentioned above, the layout and the horizontal and vertical pitches of the plurality of first and second contact pieces forming the contact piece groups can fit in with the layout and the horizontal and vertical pitches of terminal pin groups for thin and thick conductors of a plug-type multipolar electrical connector using a composite cable. Accordingly, such a plug-type multipolar electrical connector can be used as a counter connector. Further, by connecting the plurality of first contact pieces to the thin conductors of the composite cable and by connecting the plurality of second contact pieces to the thick conductors of the composite cable, the respective contact pieces can be readily connected to the respective conductors of the composite cable having different diameters. Accordingly, the socket-type multipolar electrical connector of the present invention can be miniaturized with the density of the contact pieces increased.

According to the present invention, the socket-type multipolar electrical connector may further comprise: a first contact-piece holding hole group having a plurality of first contact-piece holding holes formed in the body and arranged at a plurality of levels in the vertical direction of the body with the horizontal pitch between each adjacent hole being fine, the first contact-piece holding holes being adapted such that terminal pins of a plug-type multipolar electrical connector are respectively inserted therein; and a second contact-piece holding hole group having a plurality of second contact-piece holding holes formed in the body at a lateral side of the first contact-piece holding hole group and arranged at a plurality of levels in the vertical direction of the body with the horizontal pitch between each adjacent hole being coarse, the second contact-piece holding holes being adapted such that terminal pins of the plug-type multipolar electrical connector are respectively inserted therein; the first contact pieces being respectively fitted in and held by the first contact-piece holding holes, and the second contact pieces being respectively fitted in and held by the second contact-piece holding holes.

According to the socket-type multipolar electrical connector having the arrangement mentioned above, the layout and the horizontal and vertical pitches of the first and second contact-piece holding holes can fit in with the layout and the horizontal and vertical pitches of terminal pin groups for thin and thick conductors of a plug-type multipolar electrical connector using a composite cable. Accordingly, such a plug-type multipolar electrical connector can be used as a counter connector. Further, the respective contact pieces can be fitted in and held by the first and second contact-piece holding holes. Accordingly, even though each of the contact pieces is made in the form of a very slender piece to miniaturize the connector in its entirety, the first and second contact-piece holding holes securely maintain the shapes of the contact pieces, thus restraining the contact pieces from being deformed.

According to the present invention, the socket-type multipolar electrical connector may comprise: a first terminal group comprising a plurality of first terminals extending downwardly from and at right angles to the rear end portions of the first contact pieces forming the first contact piece group; and a second terminal group comprising a plurality of second terminals extending downwardly from and at right angles to the rear end portions of the second contact pieces forming the second contact piece group, the plurality of first and second terminals which form the terminal groups being arranged in an assembly pattern similar to the assembly pattern in which the contact pieces forming the contact piece groups are arranged. When it is said in the foregoing that the assembly pattern of the terminals is similar to the assembly pattern of the contact pieces, this means that the layout or arrangement of the terminal is generally similar to the layout or arrangement of the contact pieces. More specifically, it means that, when the contact pieces are arranged in a grid manner, the terminals are also arranged in a grid manner. Accordingly, it does not mean that the horizontal and vertical pitches of the terminals are identical to those of the contact pieces in terms of numerical values.

According to the socket-type multipolar electrical. connector having the arrangement mentioned above, the assembly pattern of the terminals forming the terminal groups, is similar to the assembly pattern of the contact pieces forming the contact piece groups. Accordingly, the terminals forming the terminal groups can be regularly arranged, thus enabling the production steps to be simplified.

According to the present invention, the socket-type multipolar electrical connector may further comprise a plate-like terminal holder having terminal holding holes arranged in an assembly pattern identical with the assembly pattern in which the terminal groups are arranged, the terminals which form the terminal groups, being respectively inserted into the terminal holding holes, and the terminal holder being fitted in an opening at the bottom of the rearward portion of the body.

According to the socket-type multipolar electrical connector having the arrangement mentioned above, the terminal holder can securely maintain the terminals forming the terminal groups in predetermined pitches. Further, the terminal holder can maintain the shapes of the terminals, thus restraining the terminals from being deformed, even though each of the terminals is made in the form of a very slender piece.

According to the present invention, the socket-type multipolar electrical connector may further comprise a shield cover comprising, in a unitary structure: a case-like portion put on the forward portion of the body; an intermediate plate portion so put on the rearward portion of the body as to surround the top and lateral sides of the rearward portion, the intermediate plate portion integrally having terminals which extend downwardly; and a rear surface portion for closing an opening at the rear side of the body, the rear surface portion being bent at a boundary part thereof between the rear surface portion and the intermediate plate portion, to thereby close the opening of the body.

According to the socket-type multipolar electrical connector having the arrangement mentioned above, the shield cover can make the entire connector in a compact design in external appearance. Further, the shield cover has, in a unitary structure, the case-like portion which surrounds the forward portion of the body, the intermediate plate portion which surrounds the top and lateral sides of the rearward portion of the body, and the rear surface portion which closes the opening of the body. This provides for an excellent shielding performance as an anti-noise measure. Further, when the terminals integrally formed at the shield cover are used as grounding terminals, the shielding performance can be further enhanced. Thus, the present invention can provide a socket-type multipolar electrical connector which meets the demand for miniaturization and higher density and which is excellent in shielding performance as a anti-noise measure.

According to the present invention, the socket-type multipolar electrical connector may be arranged such that there is formed, between the case-like portion of the shield cover and the forward portion of the body on which the case-like portion is put, a space in which a shield cover of a plug-type electrical connector is adapted to be fitted, and that the case-like portion has a top plate portion, inclined surfaces extending, as downwardly inclined, from both transverse ends of the top plate portion, a pair of lateral plates extending downwardly from the lower ends of the inclined surfaces, and a lower plate portion extending between the lateral plates.

According to the socket-type multipolar electrical connector having the arrangement mentioned above, the upper portion of the shield cover is different in shape from the lower portion thereof. This effectively prevents a plug-type multipolar electrical connector from being erroneously inserted. Such an erroneous-insertion preventive function prevents the contact pieces from being deformed due to erroneous insertion of a plug-type multipolar electrical connector.

According to the present invention, the socket-type multipolar electrical connector may be arranged such that the case-like portion of the shield cover is provided in the pair of lateral plates thereof with engagement holes into and from which locking projections of a shield cover of a plug-type electrical connector are adapted to be fitted and removed.

According to the arrangement mentioned above, the socket-type multipolar electrical connector can be securely connected to its counter connector or plug-type multipolar electrical connector, and the socket-type multipolar electrical connector as connected to its counter connector or plug-type multipolar electrical connector is prevented from being unexpectedly removed therefrom.

These and other feabures, objects and advantages of the present invention will be more fully apparent from the following description of embodiments thereof.

DETAILED DESCRIPTION OF THE PREFERRED EMBODIMENTS

Figure 1:
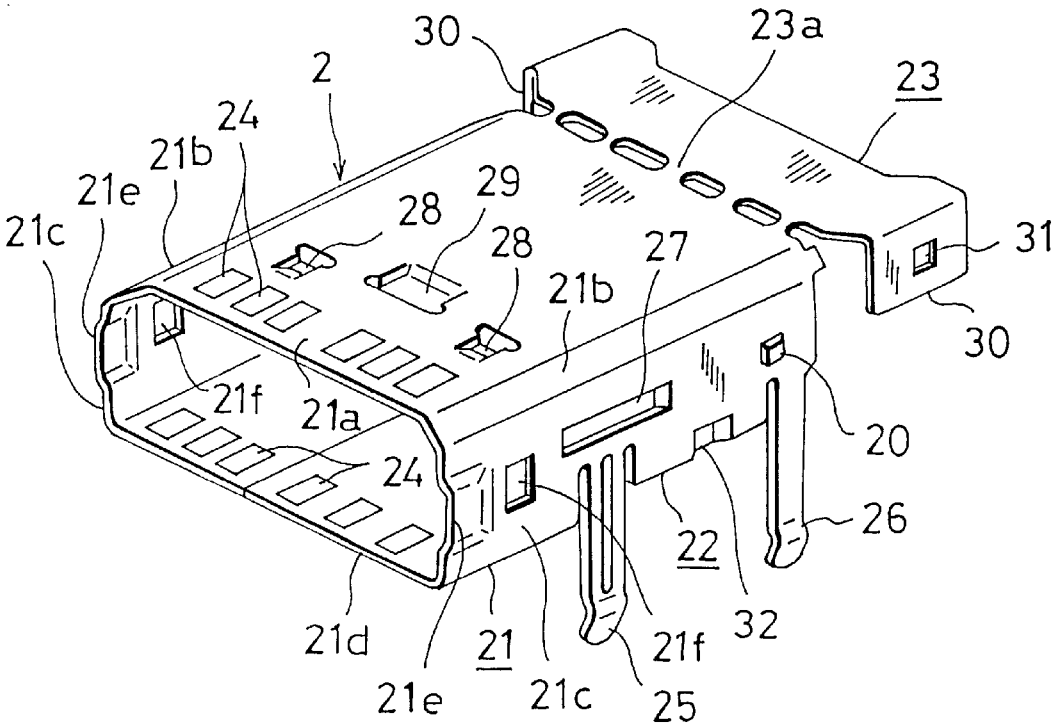
FIG. 1 is an exploded perspective view of a body, a shield cover and a terminal holder of a socket-type multipolar electrical connector according to an embodiment of the present invention.
Figure 1:
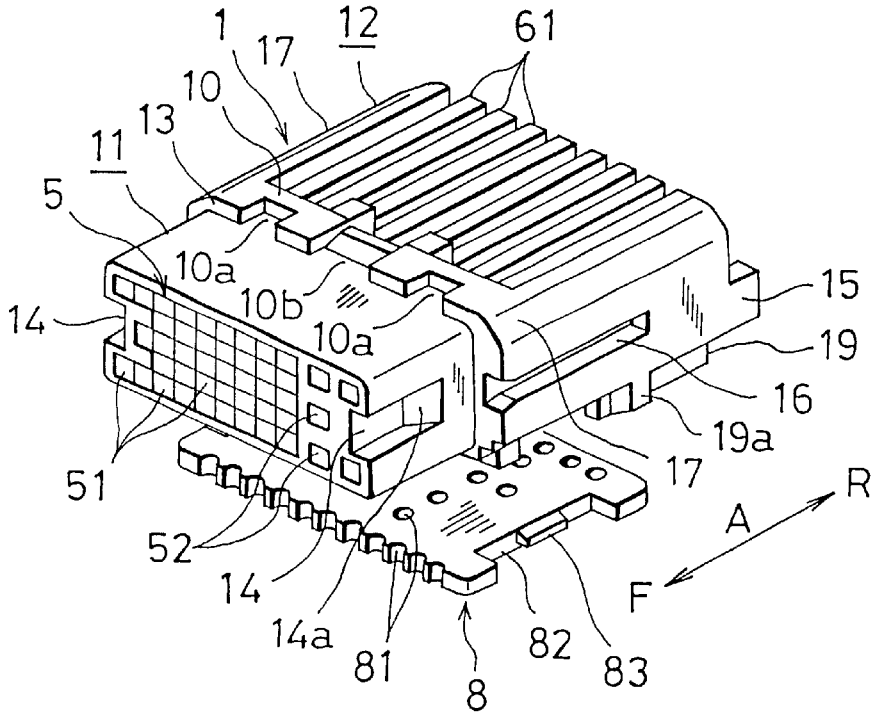

In FIG. 1, a socket-type multipolar electrical connector has a body 1, a shield cover 2, a terminal holder 8 and the like.

Figure 4:
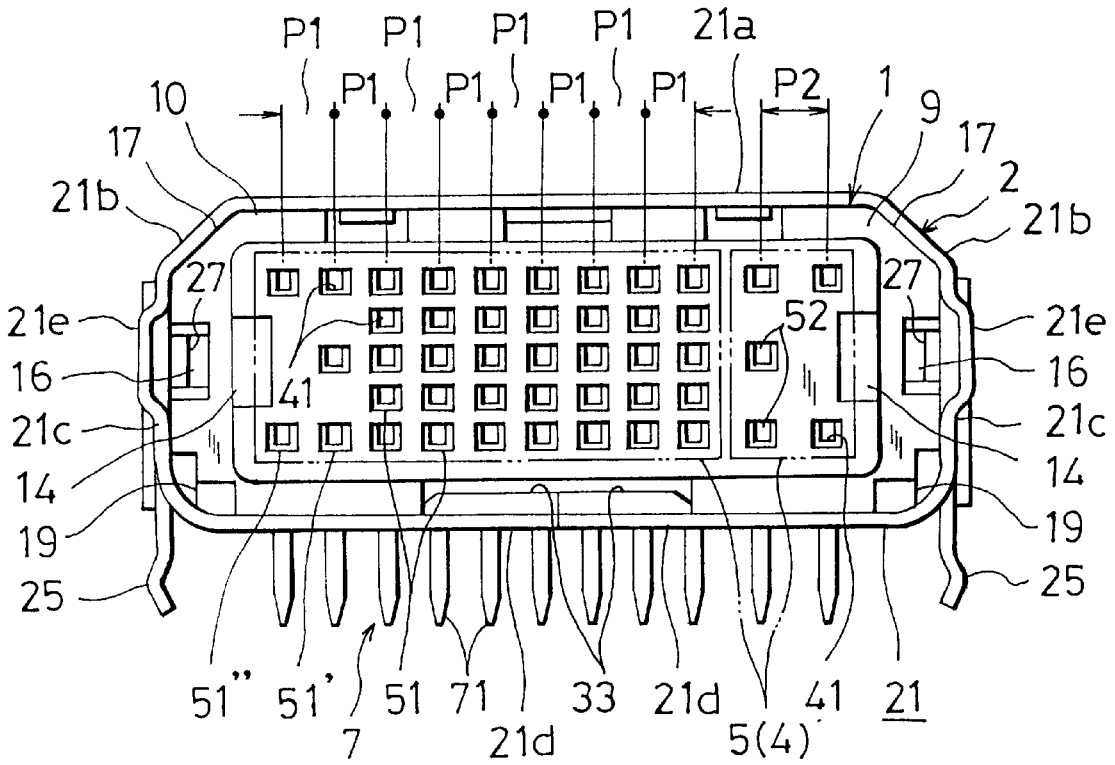
FIG. 4 is a front view of the connector shown in FIG. 1.
Figure 9:
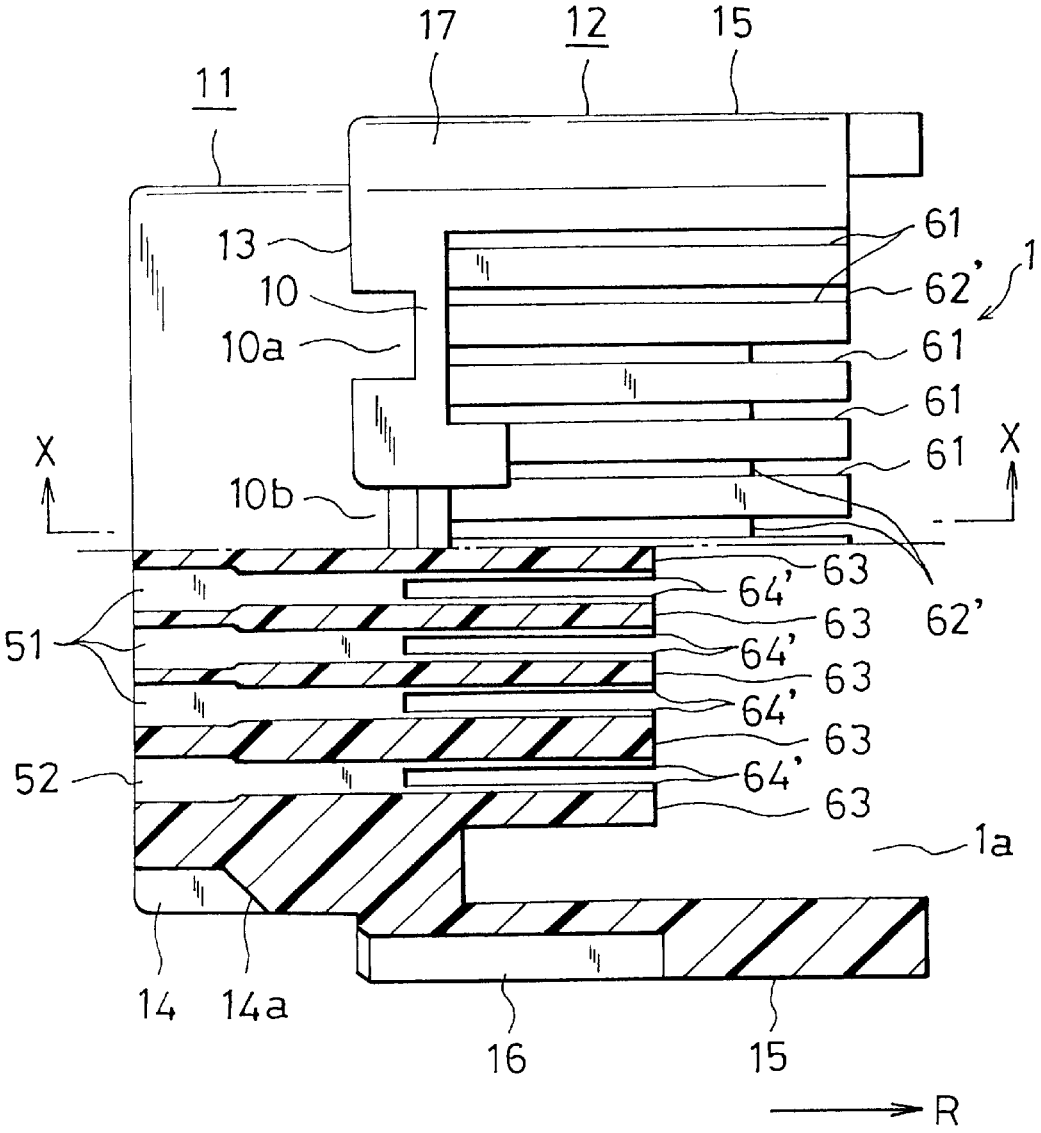
FIG. 9 is a plan view of the body with portions shown in section taken along the line 9—9 of FIG. 1.
Figure 10:
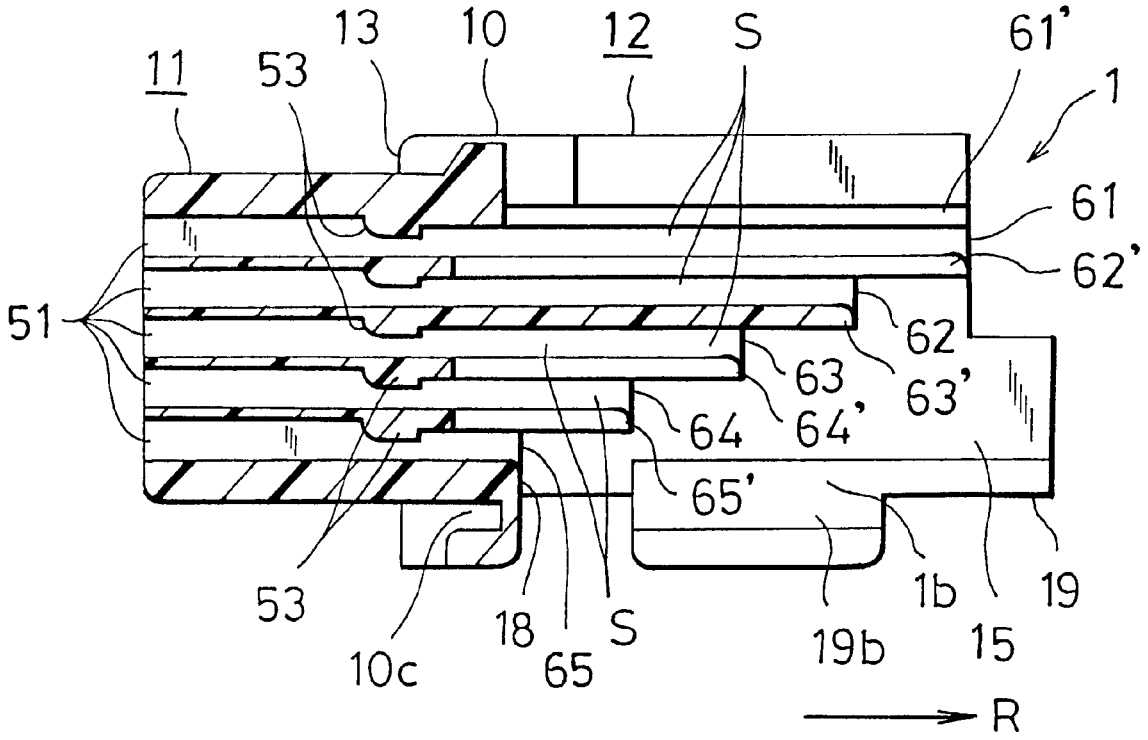
FIG. 10 is a section view taken along the line X—X in FIG. 9.

As shown in FIGS. 1, 9 and 10, the body 1 is molded from resin which has excellent insulating properties. The shape in front elevation of the body 1 is long from side to side and substantially rectangular. The body 1 has a forward portion 11, a rearward portion 12 and a stepped portion 13 at the boundary area therebetween from which the rearward portion 12 projects outwardly. In the body 1, the forward portion 11 is provided in the lateral surfaces thereof with concave grooves 14 extending in the longitudinal direction A. The concave grooves 14 are opened at the front ends thereof and are provided at the rear surfaces thereof with inclined surfaces 14*a*. The forward portion 11 of the body 1 has a plurality of contact-piece holding holes which are pierced through the forward portion 11. These contact-piece holding holes are divided into two groups, i.e., a first contact-piece holding hole group comprising a plurality of first contact-piece holding holes 51 in which the horizontal pitch P1 between each adjacent hole is fine as shown in FIG. 4, and a second contact-piece holding hole group comprising a plurality of second contact-piece holding holes 52 in which the horizontal pitch P2 between each adjacent hole is coarse as shown in FIG. 4. These first and second contact-piece holding hole groups form a contact-piece holding hole group 5. The second contact-piece holding holes 52 are formed at a lateral side of the first contact-piece holding holes 51. The first contact-piece holding holes 51 and the second contact-piece holding holes 52 are basically arranged in a grid manner in which a plurality of stages are vertically arranged (basically 5 stages in FIG. 4). In FIG. 4, the first contact-piece holding holes 51' of one row in the vicinity of the left lateral side of the body 1 are formed in three alternate stages, and the first contact-piece holding holes 51" of the left-end row are formed in the two highest and lowest stages with the intermediate three stages skipped. The second contact-piece holding holes 52 are formed substantially symmetrically with respect to the first contact-piece holding holes 51', 51". Terminal pins 300 of a plug-type multipolar electrical connector to be discussed later (See FIG. 12) are to be respectively inserted into the contact-piece holding holes 51, 52 forming the contact-piece holding hole group 5.

As shown in FIG. 10, the first contact-piece holding holes 51 have engagement projections 53 on the upper walls of the rear ends thereof. Although not shown, the second contact-piece holding holes 52 have similar engagement projections.

As understood from FIGS. 9 and 10, the body 1 is provided at the rearward portion 12 thereof with projecting walls 15 which extend from the lateral walls of the forward portion 11 in the rearward direction R. The projecting walls 15 are provided in the lateral sides thereof with concave grooves 16 extending in the longitudinal direction A. The projecting walls 15 are provided at the upper outside corners thereof with inclined surfaces 17. The rearward portion 12 of the body 1 has openings 1*a*, 1*b* at the rear side and bottom thereof, respectively. In the space between the projecting walls 15, vertical ribs 61 to 65 project in the rearward direction R from a plurality of vertical and transverse positions of the rear surface 18 of the forward portion 11 for holding the contact pieces 1. Horizontal ribs 61' to 65' are respectively formed on the vertical ribs 61 to 65 as transversely projecting ribs from the upper end edges of the vertical ribs 61 to 65. The rearwardly projecting distances of the vertical and horizontal ribs 61 to 65, 61' to 65' from the forward portion of the body are gradually reduced in the direction from the highest ribs toward the lowest ribs. Partitioned spaces S defined by the vertical and horizontal ribs 61 to 65, 61' to 65' respectively communicate with the first and second contact-piece holding holes 51, 52. In this embodiment, the horizontal rib 62' of the left-end vertical rib 62 and the horizontal rib 62' of the vertical rib 62 next to it are formed in a unitary structure in the form of a flat plate, and the horizontal rib 62' of the right-end vertical rib 62 and the horizontal rib 62' of the vertical rib 62 next to it are also formed in a unitary structure in the form of a flat plate (See FIG. 9). Further, all the horizontal ribs 63' of the vertical ribs 63 are formed in a unitary structure in the form of a flat plate (See FIG. 10).

Plate portions 19 project downwardly from the lower end edges of the projecting walls 15. The plate portions 19 are provided at the outer sides thereof with engagement projections 19*a* (See FIG. 1) and at the inner sides thereof with engagement grooves 19*b* (See FIG. 10). At the stepped portion 13, a rib 10 having three concaves 10*a*, 10*b* is formed on the top of the body 1, and a concave 10*c* is formed at the bottom of the body 1 (See FIG. 10).

As shown in FIG. 1, the shield cover 2 before it is assembled with the body 1 has, in a unitary structure, a case-like portion 21, an intermediate plate portion 22 and a rear surface portion 23 which projects from the intermediate plate portion 22 in the rearward direction R.

The case-like portion 21 has a top plate portion 21*a*, inclined plate portions 21*b* inclined downwardly from both lateral ends of the top plate portion 21*a*, a pair of lateral plates 21*c* extending downwardly from the lower ends of the inclined plate portions 21*b*, and a lower plate portion 21*d* extending between the lateral plates 21*c*. The lower plate portion 21*d* is transversely divided at the center thereof with the divided ends thereof abutting each other. The lateral plates 21*c* are provided at portions of the front end edges thereof with guide portions 21*e* which are outwardly expanded. Engagement holes 21*f* are formed immediately rearward of the guide portions 21*e*. Inwardly expanding contact portions 24 are formed at a plurality of positions of the top plate portion 21*a* and the lower plate portion 21*d* in the vicinity of the front ends thereof. The lower plate portion 21*d* has an engagement piece 33 which projects in the rearward direction R (See FIGS. 4, 8, 11).

The shape of the intermediate plate portion 22 is similar to the case-like portion 21, but lacks in the lower plate portion 21*d*. The intermediate plate portion 22 is provided at two different positions of each of the lateral sides thereof with downwardly projecting terminals 25, 26. Engagement pawls 32 are formed between the terminals 25, 26. The intermediate plate portion 22 also has inwardly expanding portions 27 at the positions corresponding to the concave grooves 16 in the body 1. At the boundary part between the intermediate plate portion 22 and the top plate portion 21*a* of the case-like portion 21, there are formed engagement pawls 28, 29 by and between which the rib 10 of the body 1 is held. The intermediate plate portion 22 is provided at the rear end portions of the lateral sides thereof with engagement projections 20.

In the rear surface portion 23, a boundary portion 23*a* between the rear surface portion 23 and the intermediate plate portion 22 is so formed as to be bent. The rear surface portion 23 is provided at the lateral sides thereof with plate pieces 30 having engagement holes 31.

The shield cover having the arrangement mentioned above may be integrally formed by punching or bending a metallic plate.

The terminal holder 8 has a plurality of terminal holding holes 81 arranged in the same assembly pattern as the assembly pattern in which terminals 71, to be discussed later, are arranged. The terminal holder 8 is provided at the lateral sides thereof with concave portions 82 having engagement projections 83.

Figure 2:
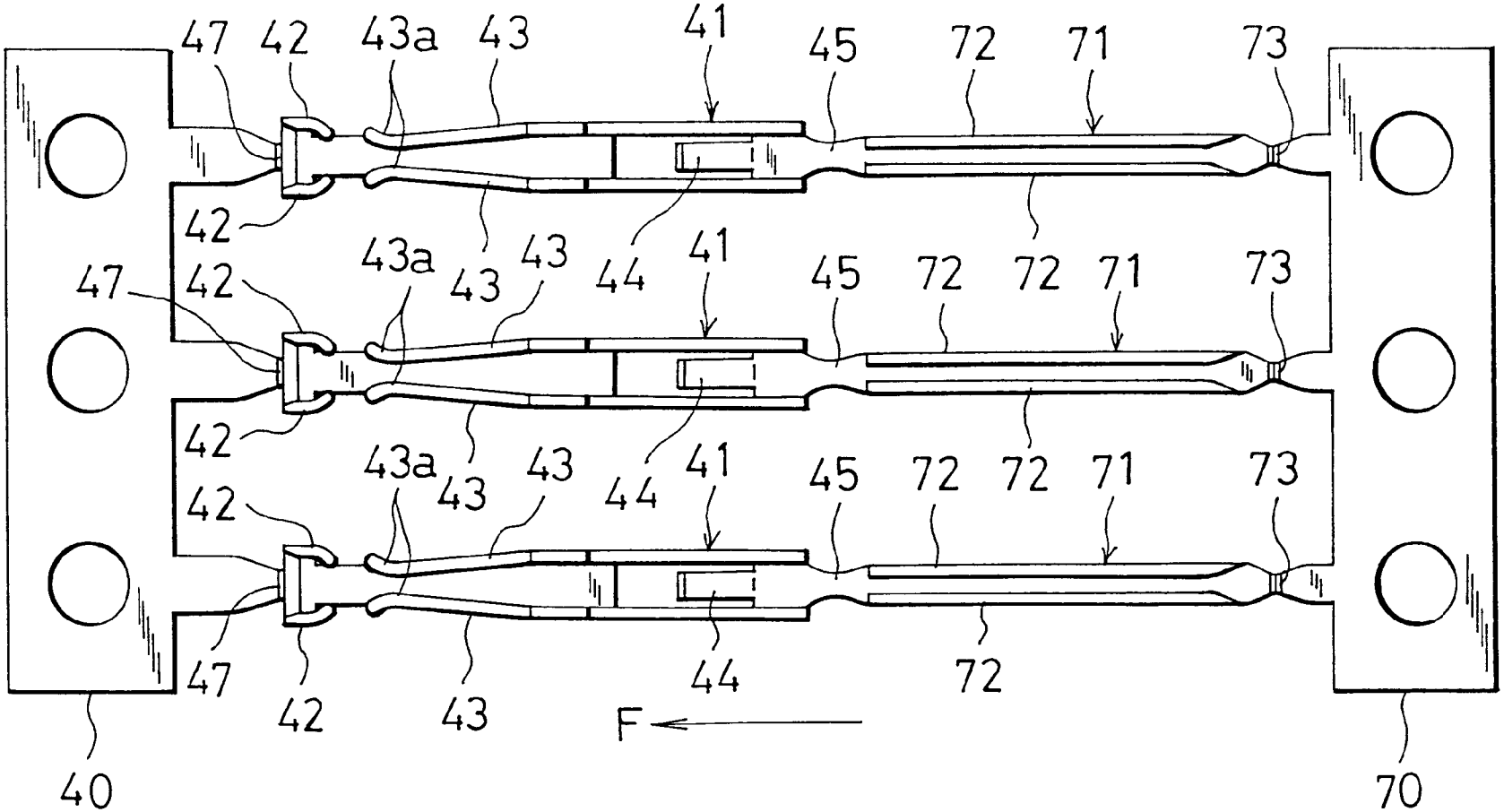
FIG. 2 is a plan view of contact pieces and terminals used in the connector shown in FIG. 1.
Figure 3:
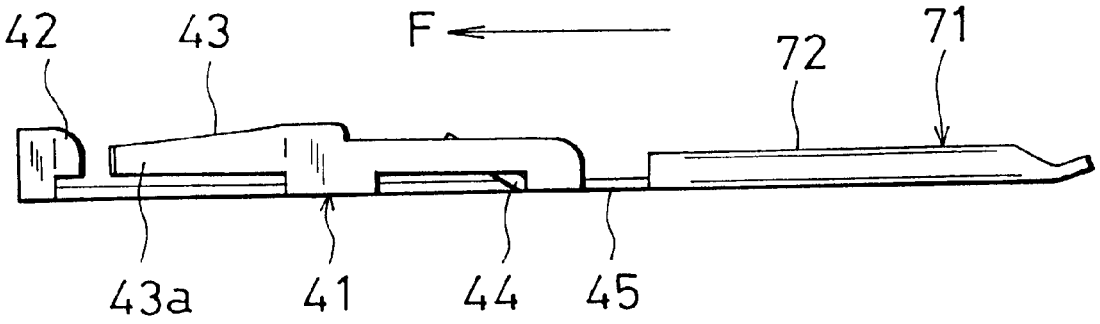
FIG. 3 is a side view of the contact pieces and terminals used in the connector shown in FIG. 1.

As shown in FIGS. 2 and 3, each contact piece 41 is made in the form of a very slender piece which has, at the front end thereof, a pair of guide pieces 42, a pair of contact-piece main bodies 43 which are raised from the rearward parts of the contact piece 41 and which extend in the forward direction F, and an engagement pawl 44 formed as cut and raised between the contact-piece main bodies 43. The contact-piece main bodies 43 are provided at the front ends thereof with contacts 43*a*. The contact pieces 41 at bent at narrow-width parts 45 before they are assembled with the first and second contact-piece holding holes 51, 52 in the body 1, to form the terminals 71 which extend in the rearward direction R. Each terminal 71 is made in the form of a very slender piece having a pair of reinforcing ribs 72. A plurality of units each of which comprises a contact piece 41 and a terminal 71 and which are connected to one another by connecting pieces 40, 70, are supplied to the assembling step.

The following description will discuss an example of assembling the socket-type multipolar electrical connector shown in the embodiment mentioned above.

Figure 5:
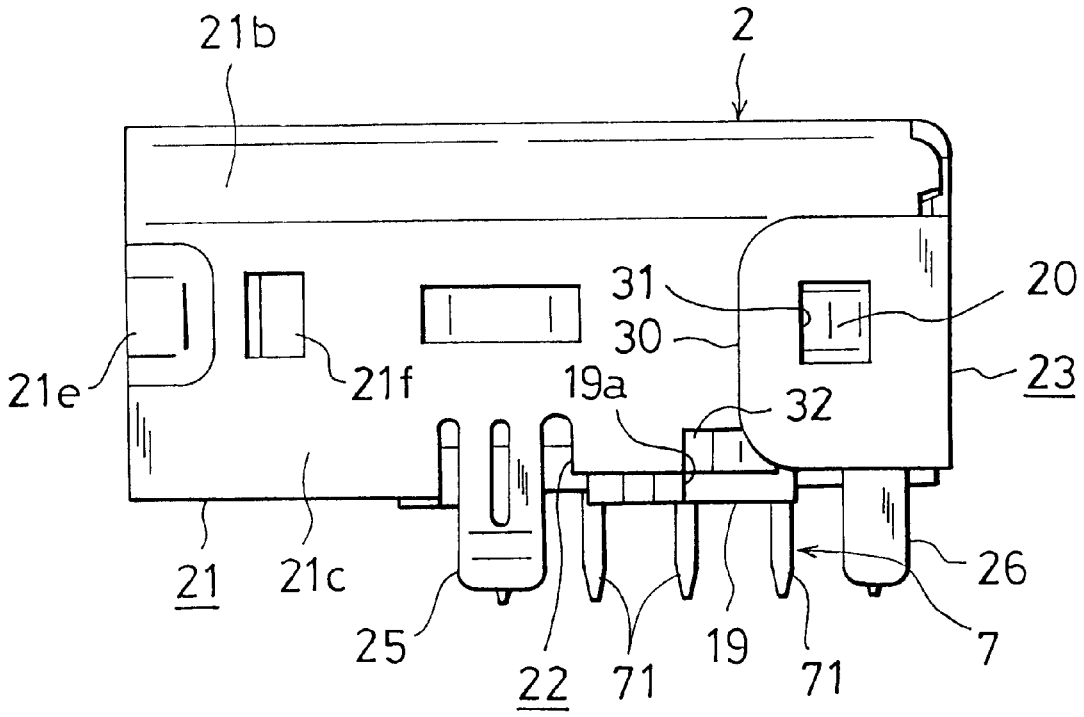
FIG. 5 is a side view of the connector shown in FIG. 1.
Figure 8:
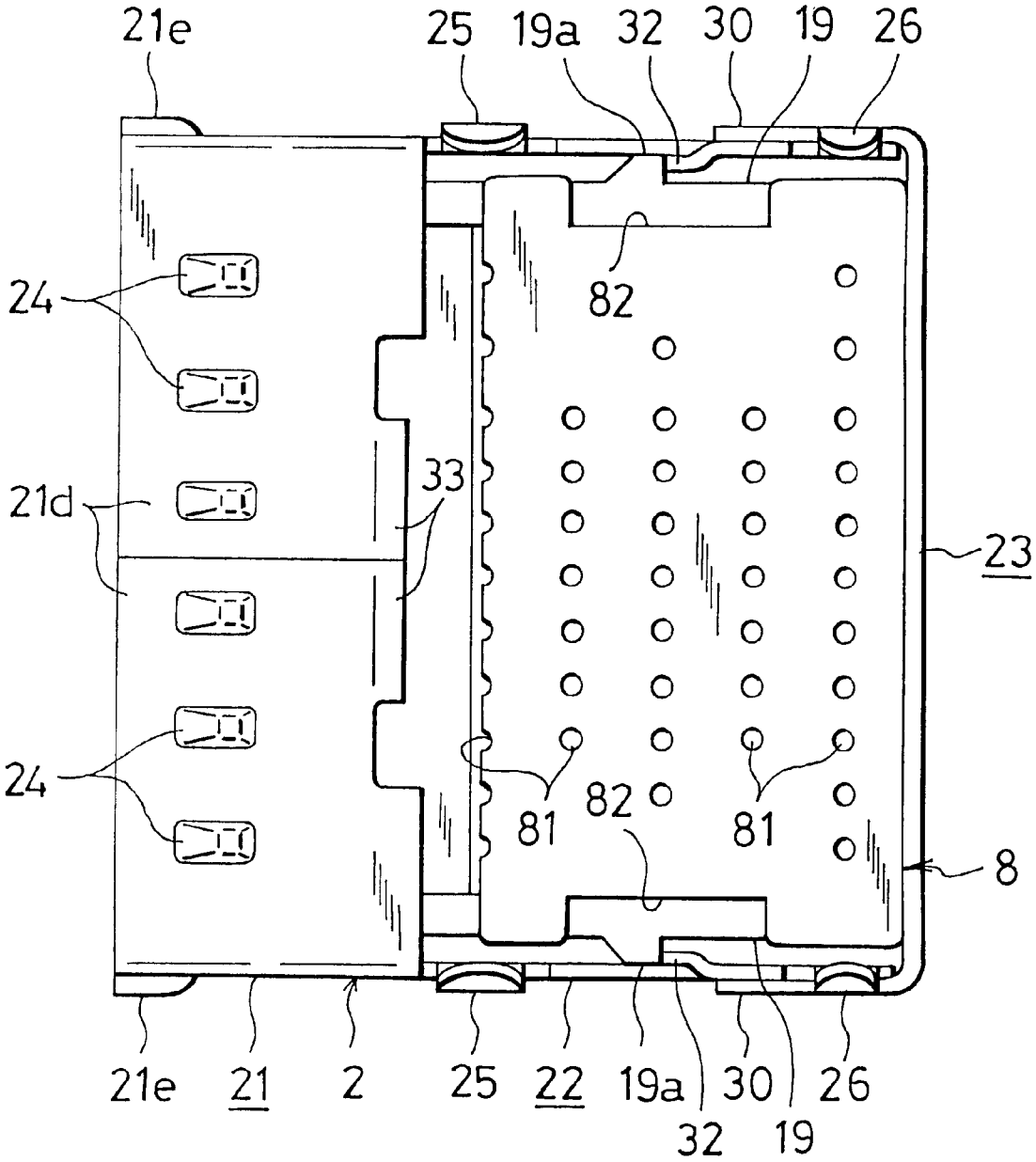
FIG. 8 is a bottom view of the connector shown in FIG. 1.
Figure 11:
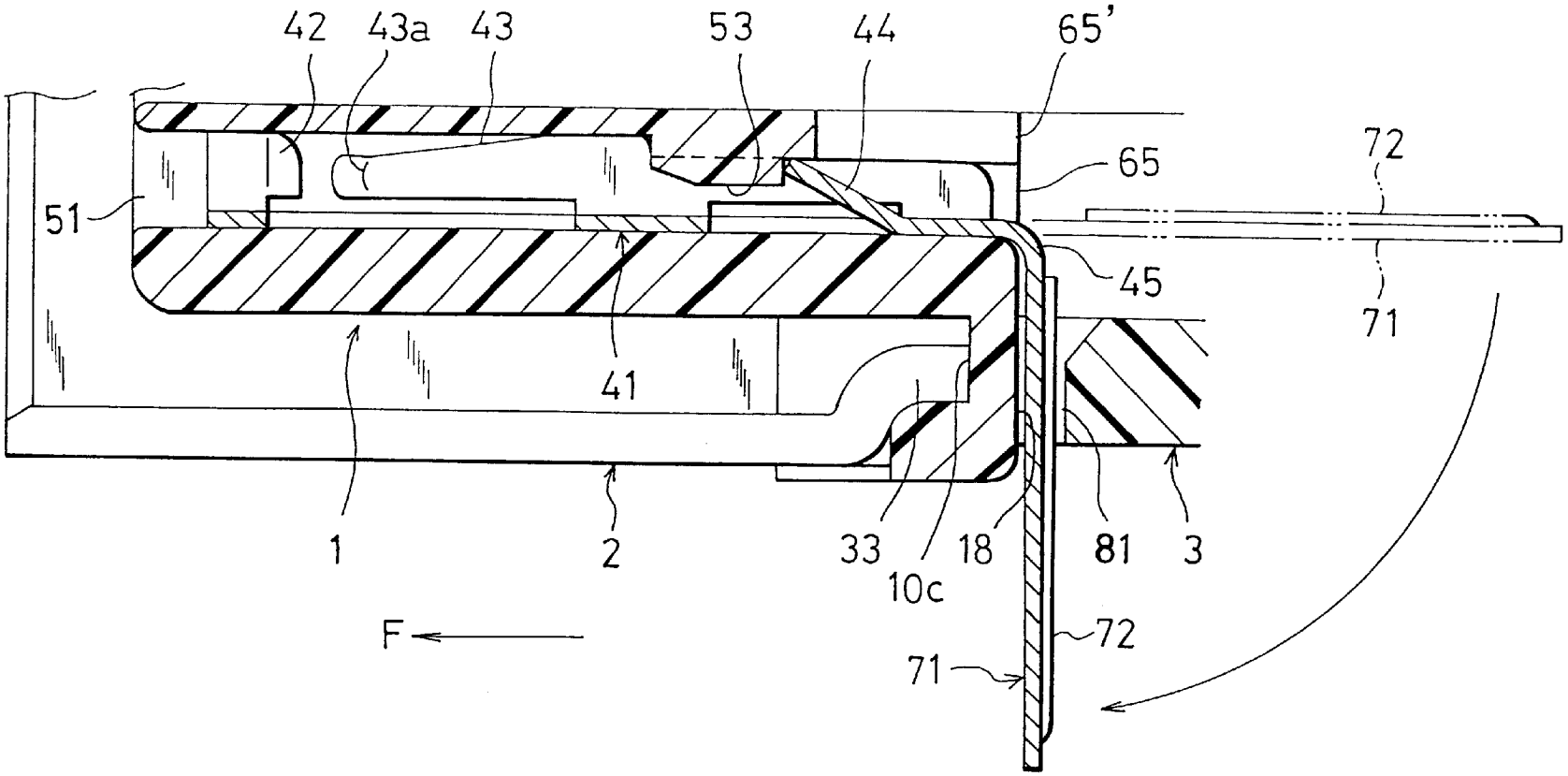
FIG. 11 is an enlarged section view of portions of the connector shown in FIG. 1.

The body 1 is inserted into the shield cover 2 as discussed in connection with FIG. 1, the rib 10 of the body 1 is held by and between the engagement pawls 28, 29 of the shield cover 2, and the engagement piece 33 of the shield cover 2 is fitted into the concave 10*c* of the body 1 as shown in FIG. 11. Further, the engagement pawls 32 of the shield cover 2 are engaged with the rear sides of the engagement projections 19*a* of the body 1 as shown in FIGS. 5 and 8.

In the units in which a predetermined number of contact pieces 41 and terminals 71 are connected to one another by the connecting pieces 40, 70 (as shown in FIG. 2), the connecting piece 70 is cut off at cutting portions 73 and separated from the terminals 71. The terminals 71 are inserted into the corresponding first and second contact-piece holding holes 51, 52 from the front side of the body 1, so that the respective contact pieces 41 are fitted in the partitioned spaces S in the corresponding first and second contact-piece holding holes 51, 52. Accordingly, the shapes of the contact pieces 41 are maintained by the first contact-piece holding holes 51 and the second contact-piece holding holes 52. This prevents the contact pieces 41 from being deformed even though each of the contact pieces 41 is made in the form of a very slender piece so that the connector is miniaturized in its entirety. After the contact pieces 41 have been respectively fitted in and held by the first contact-piece holding holes 51 and the second contact-piece holding holes 52, the connecting piece 40 is cut off and separated at cutting portions 47 (See FIG. 2). Thus, as shown in FIG. 11 which shows the contact pieces 41 fitted in the first contact-piece holding holes 51 at the lowest stage, the engagement projections 53 are fitted between the pairs of the contact-piece main bodies 43 and the engagement pawls 44. The engagement of the engagement pawls 44 with the engagement projections 53 prevents the contact pieces 41 from being positionally shifted in the forward direction F.

The contact pieces 41 fitted in and held by the first contact-piece holding holes 51 and the second contact-piece holding holes 52 form a contact piece group 4 (See FIG. 4). The assembly pattern of the contact pieces 41 forming the contact piece group 4 is the same as the assembly pattern in which the first and second contact-piece holding holes 51, 52 forming the contact-piece holding hole group 5 are arranged.

As apparent from the description of the arrangement of the first contact-piece holding holes 51 and the second contact-piece holding holes 52, the assembly pattern of the contact pieces 41 in this embodiment is basically arranged in a grid manner in which a plurality of stages are vertically arranged (basically 5 stages in FIG. 4). The assembly pattern of the contact pieces 41 is identical with that of terminal pins 300 for thin and thick conductors in a plug-type multipolar electrical connector using a composite cable. With such an arrangement, this socket-type multipolar electrical connector can be used as the counter connector of the plug-type multipolar electrical connector.

Thus, when the contact pieces 41 are fitted in and held by the first contact-piece holding holes 51, and the second contact-piece holding holes 52 and their partitioned spaces S, the terminals 71 extending from the contact pieces 41 project into the space between the pairs of the projecting walls 15 of the body 1. The terminals 71 projecting from the partitioned space S of the same stage are simultaneously bent at the narrow-width parts 45 thereof, successively starting from the terminals 71 projecting from the partitioned space S at the lowest stage (FIG. 11 shows the state where the terminals 71 at the lowest stage are bent), so that the terminals 71 extend downwardly at right angles to the contact-piece main bodies 43.

Figure 6:
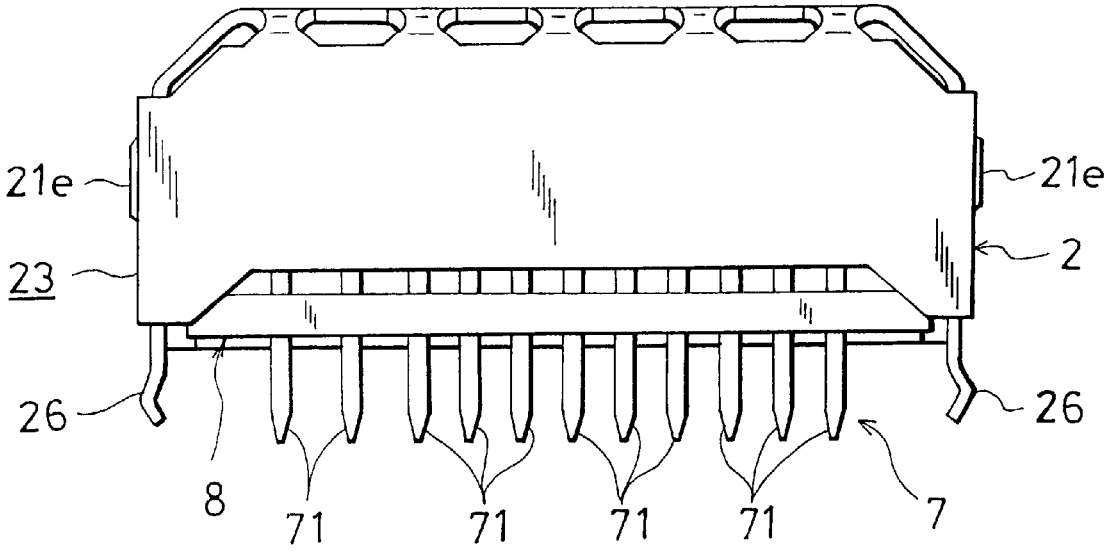
FIG. 6 is an end view of the connector shown in FIG. 1.
Figure 7:
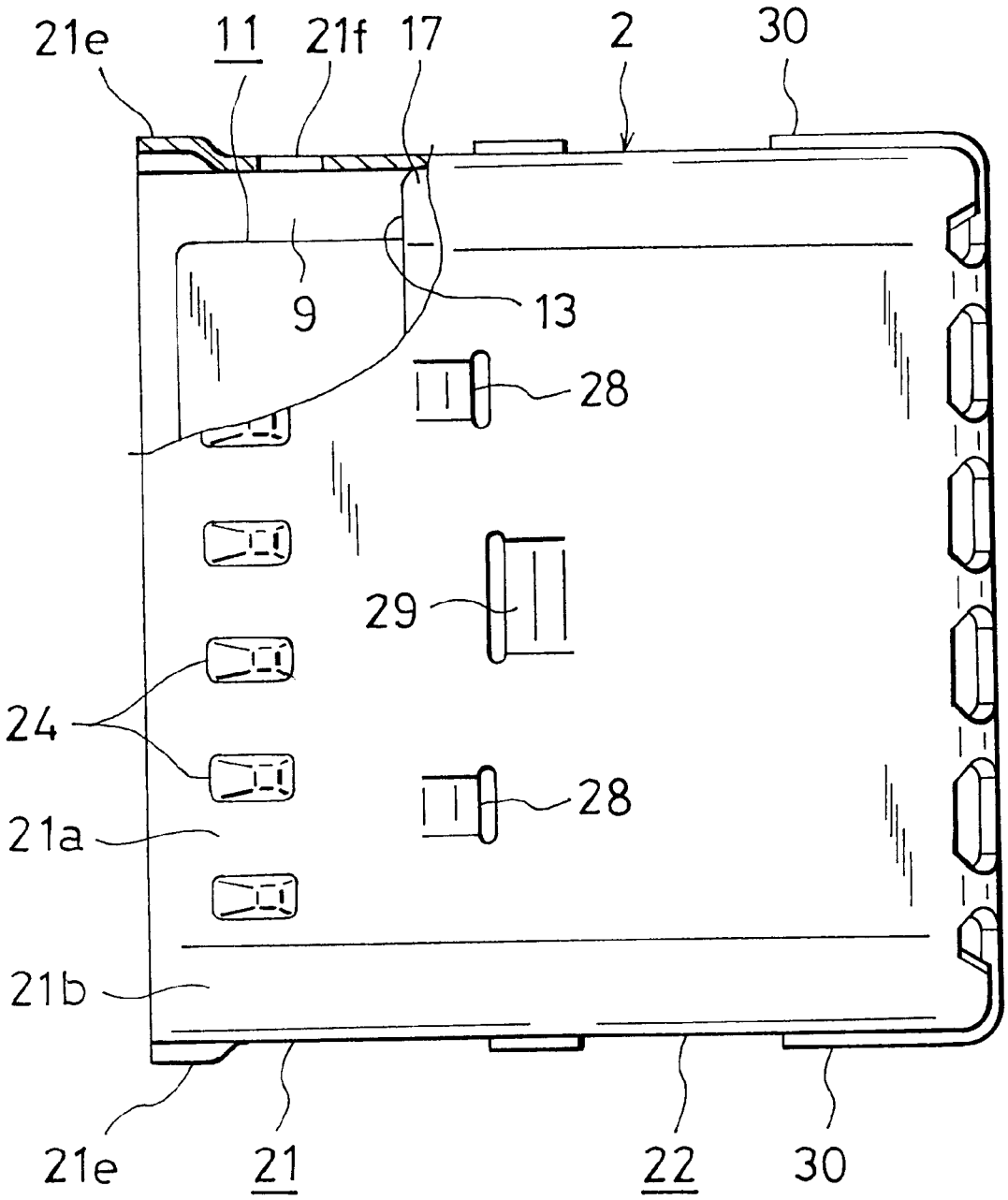
FIG. 7 is a plan view, with portions broken away, of the connector shown in FIG. 1.

The terminals 71 thus perpendicularly bent form a terminal group 7 (See FIGS. 4 to 6). The assembly pattern in which the terminal group 7 is arranged, is similar to that of the contact pieces 41. More specifically, the arrangement of the respective terminals 71 forming the terminal group 7 is generally similar to the arrangement of the respective contact pieces 41 forming the contact piece group 4. In the embodiment, the terminals 71 are basically arranged in a grid manner in the transverse and longitudinal directions. The transverse pitch between each adjacent terminals 71 is the same as the horizontal pitch P1 between each adjacent contact pieces 41. The longitudinal pitch of the terminals 71 is slightly greater than the vertical pitch of the contact pieces 41. With such an arrangement, the terminals 71 can be regularly arranged. This is useful for simplifying the production steps. The assembly pattern of the terminal holding holes 81 in the terminal holder 8 is the same as the assembly pattern of the terminals 71 forming the terminal group 7.

The terminals 71 forming the terminal group 7 are respectively inserted into the terminal holding holes 81 of the terminal holder 8, and the terminal holder 8 is fitted into the opening 1*b* (See FIG. 10) at the bottom of the rearward portion of the body 1 as shown in FIG. 6 or 8. Accordingly, the terminal holder 8 not only securely maintains the terminals 71 in a predetermined pitch, but also prevents the contact pieces 41 from being positionally shifted in the rearward direction R. Further, the terminal holder 8 can maintain the shapes of the terminals 71. This causes the terminals 71 to be hardly deformed even though each of the terminals 71 is made in the form of a very slender piece. To fit the terminal holder 8 into the opening 1*b*, the concave portions 82 of the terminal holder 8 are fitted to the plate portions 19 of the body 1 and the engagement projections 83 of the concave portions 82 are engaged with the engagement grooves 19*b* (See FIG. 10) of the plate portions 19, as shown in FIGS. 5 and 8.

After or before the terminal holder 8 is mounted on the body 1 in the manner mentioned above, the rear surface portion 23 of the shield cover 2 is bent at the boundary portion 23*a*. Accordingly, the rear surface portion 23 closes the opening 1*a* at the rear side of the body 1, and the plate pieces 30 are opposite to the lateral sides of the intermediate plate portion 22 such that the engagement holes 31 are engaged with the engagement projections 20.

The procedure mentioned above is shown as a mere example, and the assembling procedure should not be limited to that mentioned above.

In the socket-type multipolar electrical connector shown in FIGS. 4 to 8, the forward portion 11 of the body 1 is wholly surrounded by the case-like portion 21 of the shield cover 2, and the top and lateral sides of the rearward portion 12 of the body 1 are surrounded by the intermediate plate portion 22 of the shield cover 2, and the opening 1*a* at the rear end side of the body 1 is closed by the rear surface portion 23 of the shield cover 2. In addition, the terminal holder 8 closes the opening 1*b* at the bottom of the body 1. Such an arrangement provides an excellent shielding function as an anti-noise measure. The terminals 25, 26 integrally formed at the shield cover 2 are grounded. This further improves the shielding performance of the connector.

Between the forward portion 11 of the body 1 inserted into the case-like portion 21 of the shield cover 2 and the case-like portion 21, there is formed a space 9 (See FIGS. 4 and 7) into which a case-like shield cover 100 of a plug-type multipolar electrical connector to be discussed later, can be fitted. Since the upper and lower portions of the case-like portion 21 are formed asymmetrically with each other, the plug-side shield cover 100 can be fitted to the space 9 only in a predetermined orientation. This effectively prevents the plug-type multipolar electrical connector from being erroneously inserted.

Figure 12:
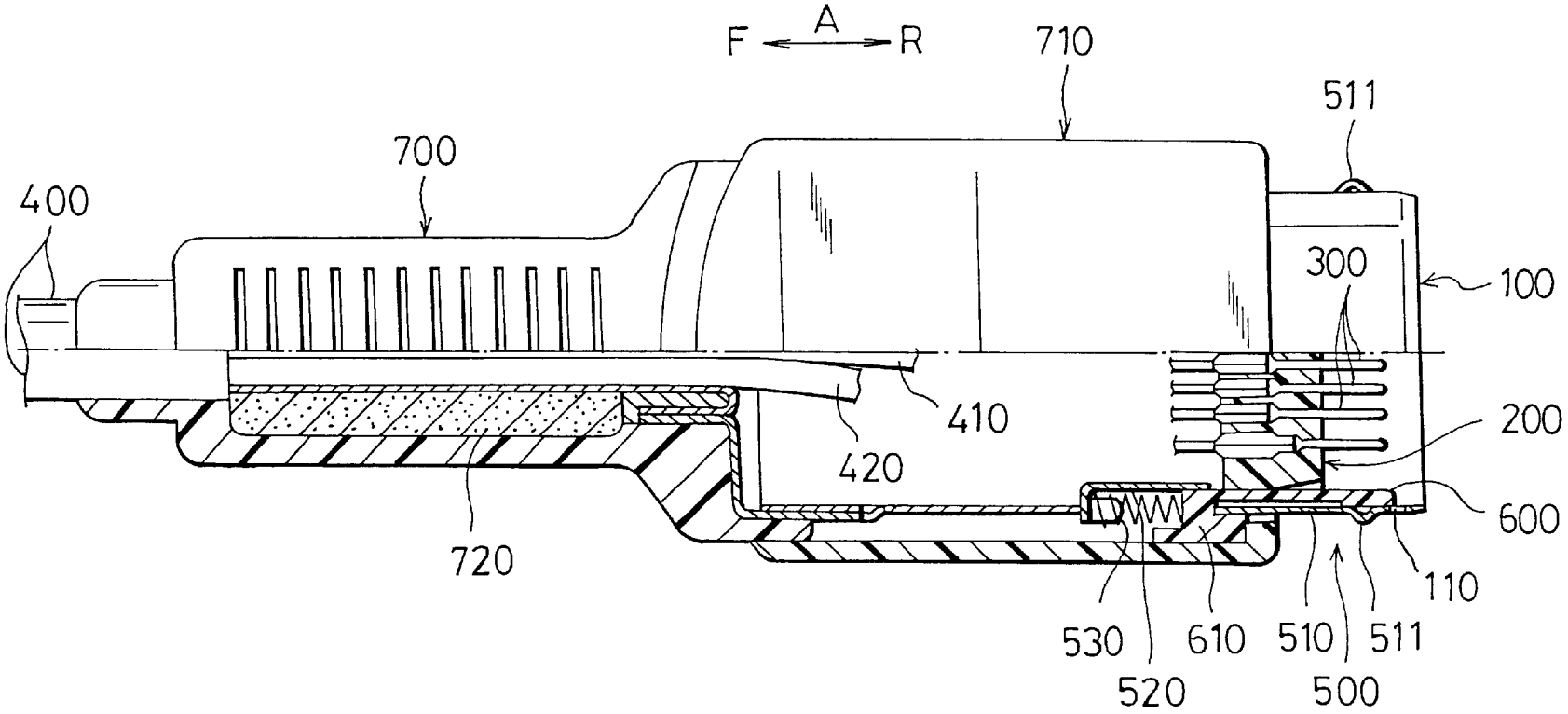
FIG. 12 is a plan view of a plug-type multipolar electrical connector with portions shown in section.

With reference to FIG. 12, the following description will discuss the arrangement of the plug-type multipolar electrical connector which serves as a counter connector of the socket-type multipolar electrical connector.

The plug-type multipolar electrical connector comprises the shield cover 100, a body 200 surrounded by the shield cover 100 and a plurality of terminal pins 300 assembled with the body 200 in the same pattern as that of the contact pieces 41, the terminal pins 300 being connected to thin conductors 410 and thick conductors 420 of a composite cable 400. The shield cover 100 is provided at the lateral sides thereof with locking mechanisms 500. The locking mechanisms 500 have, in a unitary structure, (i) resilient movable pieces 510 provided at the tips thereof with projections 511 formed by bending the tips of the movable pieces 510, and (ii) holding frame portions 520 integrally formed at the base end portions of the movable pieces 510. The holding frame portions 520 are so arranged as to house and hold spring members 530 and base portions 610 of sliders 600 normally biased in the rearward direction R by the spring members 530. The movable pieces 510 are housed in openings 110 extending in the longitudinal direction A formed in the shield cover 100. There are also disposed a strain relief 700, a sleeve 710 and a ferrite core 720.

With reference to FIGS. 13 to 16, the following description will discuss how the plug-type multipolar electrical connector is connected to the socket-type multipolar electrical connector, and how the both connectors as connected to each other are disconnected from each other.

Figure 13:
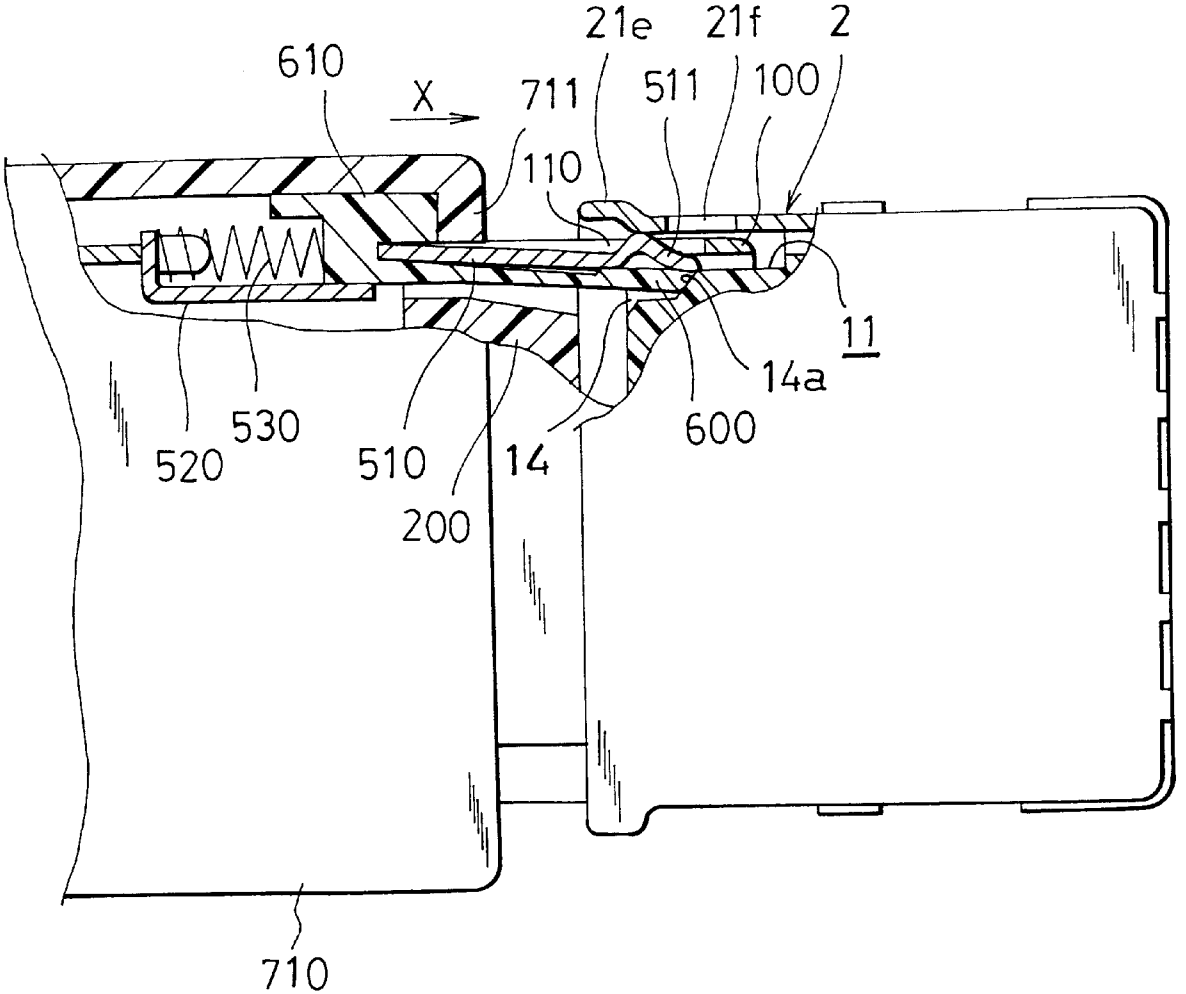
FIG. 13 is a view, with portions broken away, a stage of an operation of connecting the socket-type multipolar electrical connector to the plug-type multipolar electrical connector.
Figure 14:
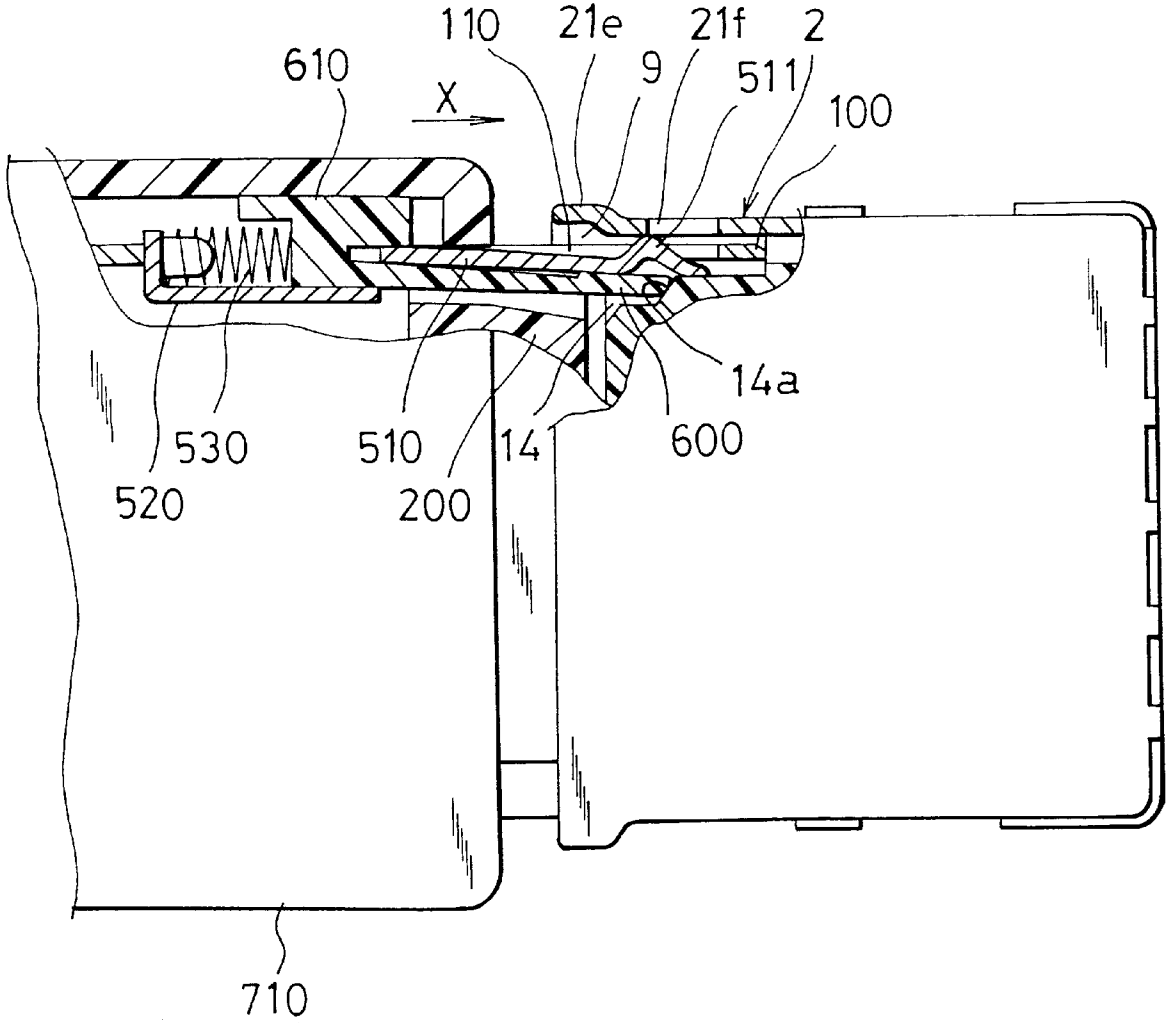
FIG. 14 is a view illustrating another stage of the operation of connecting the socket-type multipolar electrical connector to the plug-type multipolar electrical connector.

For connecting the plug-type multipolar electrical connector to the socket-type multipolar electrical connector, the rear end portion (the right end in FIG. 13) of the shield cover 100 of the plug-type multipolar electrical connector -Ls inserted into the space 9 between the forward portion 11 of the body 1 and the case-like portion 21 of the shield cover 2 in the socket-type multipolar electrical connector. At the first stage, the projections 511 of the movable pieces 510 are guided by the guides 21*e* of the shield cover 2, so that the movable pieces 510 pass through the guides 21*e* while the sliders 600 fitted in the concave grooves 14 are bent and inwardly displaced. Immediately after the projections 511 have passed through the guides 21*e*, the tips of the sliders 600 come in contact with the inclined surfaces 14*a* of the concave grooves 14, as shown in FIG. 13. When the plug-type multipolar electrical connector is further inserted, only the movable pieces 510 are moved forward as shown in FIG. 14, and the sliders 600 which remain in contact with the inclined surfaces 14*a*, are prevented from being moved forward, so that the spring members 530 are compressed. When the plug-type multipolar electrical connector is further inserted in the direction X from the position shown in FIG. 14, the projections 511 reach the engagement holes 21*f* formed in the shield cover 2. At this time, the movable pieces 510 are outwardly displaced and reset due to the resiliency thereof, so that the projections 511 are fitted into the engagement holes 21*f*. Thus, when the projections 511 are fitted into the engagement holes 21*f*, the sliders 600 are displaced and reset, and the sliders 600 are then pushed out by the spring loads of the spring members 530. Then, the sliders 600 are fitted between the shield cover 2 and the surface of the forward portion 11 of the body 1. Accordingly, the sliders 600 are backed up from the back sides thereof by the surface of the forward portion 11 of the body 1, to thereby prevent the movable pieces 510 from being inwardly displaced. Accordingly, even though the composite cable 400 or the strain relief 700 is pulled, there is no possibility of the projections 511 coming out from the engagement holes 21*f*. This prevents the plug-type multipolar electrical connector from unexpectedly coming out from the socket-type multipolar electrical connector.

Figure 15:
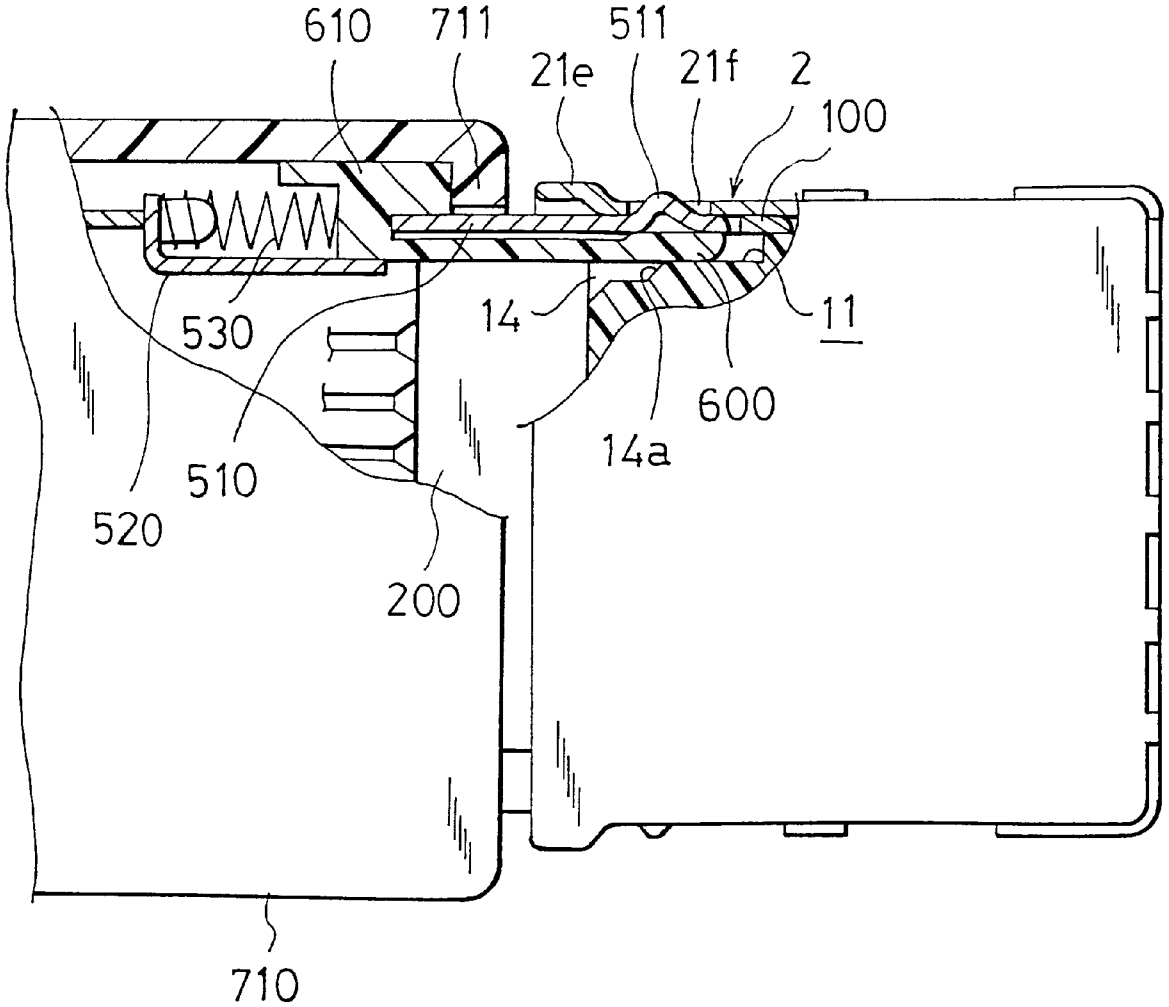
FIG. 15 is a view illustrating a further stage of the operation of connecting the socket-type multipolar electrical connector to the plug-type multipolar electrical connector.
Figure 16:
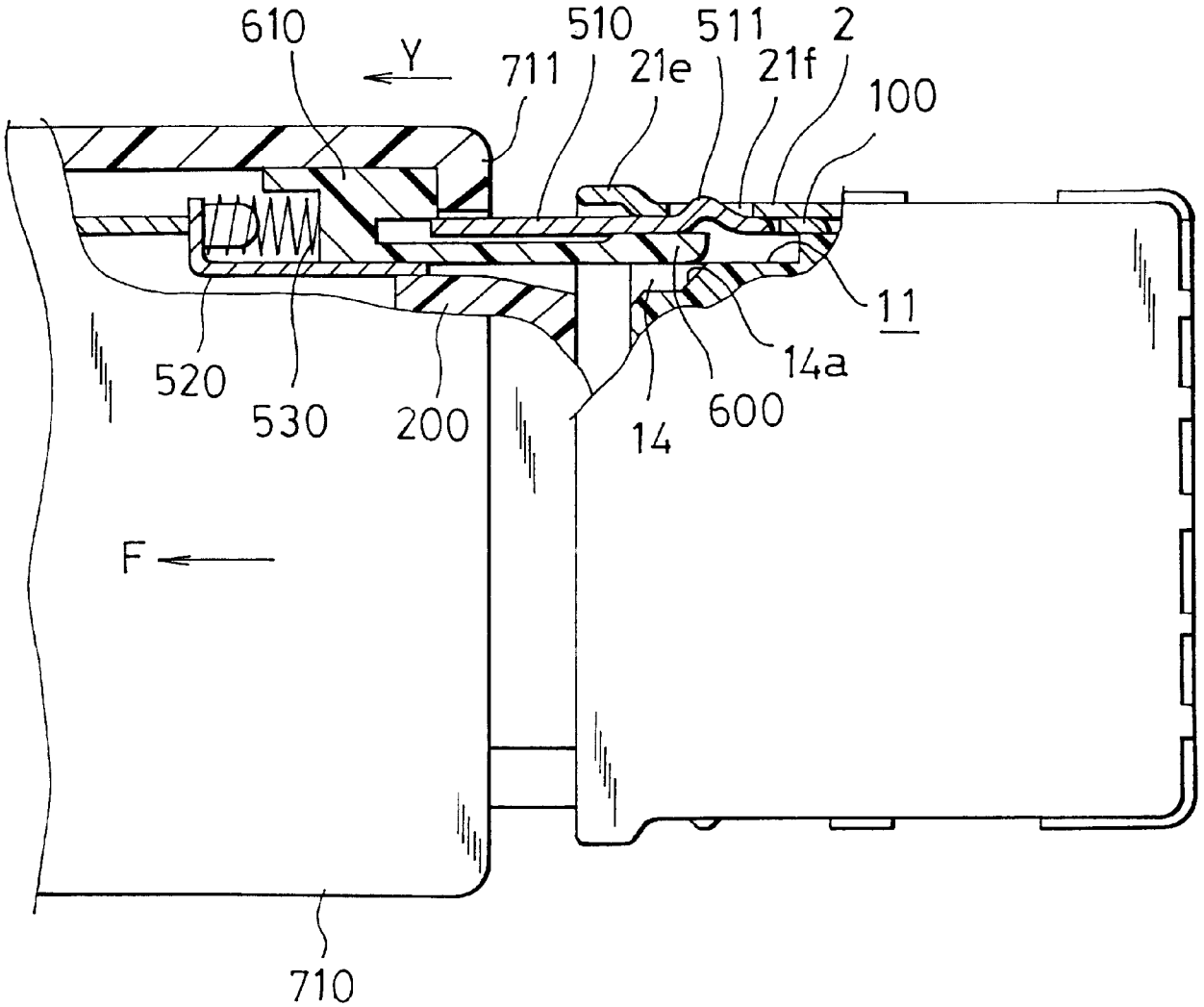
FIG. 16 is a view, with portions broken away, illustrating an operation of removing the socket-type multipolar electrical connector from the plug-type multipolar electrical connector.

For pulling out the plug-type multipolar electrical connector as connected to the socket-type multipolar electrical connector as shown in FIG. 15, from the socket-type multipolar electrical connector, the plug-type multipolar electrical connector can be pulled out in a direction shown by an arrow Y in FIG. 16 with the sleeve 710 held with the hand. At the first stage, the engagement portion 711 of the sleeve 710 engaged with the rear ends of the base portions 610 of the sliders 600, pushes the base portions 610 in the forward direction F (See FIG. 1), so that the sliders 600 are retreated against the spring loads of the spring members 530. Then, as shown in FIG. 16, the sliders 600 come out from between the surface of the forward portion 11 of the body 1 and the movable pieces 510 to form gaps at the back sides of the movable pieces 510. This enables the movable pieces 510 to be inwardly displaced. Accordingly, when the plug-type multipolar electrical connector is further pulled out, the pulling force causes the projections 511 to be inwardly pulled out from the engagement holes 21*f*. Then, the movable pieces 510 and the shield cover 100 are pulled out from the shield cover 2, so that the plug-type multipolar electrical connector is removed from the socket-type multipolar electrical connector.

In such inserting and removing operations, the projections 511 are engaged with the engagement holes 21*f* at the left- and right-hands of both electrical connectors. This enables the inserting and pulling operations to be carried out in a well balanced manner.

What is claimed is:

1. A socket-type multipolar electrical connector having a plurality of contact piece groups and a body made of an insulating material in which said plurality of contact piece groups are assembled, said body having a forward portion defining a rear surface, a center and a rearward portion defining a rear side and bottom;

a first contact-piece holding hole group having a plurality of first contact-piece holding holes formed in the body and arranged at a plurality of levels in the vertical direction of said body with the horizontal pitch between adjacent holes being fine, said first contact-piece holding holes being adapted such that terminal pins of a plug-type multipolar electrical connector are respectively inserted therein; and a second contact-piece holding hole group having a plurality of second contact-piece holding holes formed in said body at a lateral side of said first contact-piece holding hole group and arranged at a plurality of levels in the vertical direction of said body with the horizontal pitch between adjacent holes being coarse, said second contact-piece holding holes being adapted such that terminal pins of said plug-type multipolar electrical connector are respectively inserted therein;

said plurality of contact piece groups comprising:

a first contact piece group including a plurality of first contact pieces which are disposed in said body at the center thereof with the horizontal pitch between each adjacent contact piece being fine; and a second contact piece group including a plurality of second contact pieces which are disposed in said body at a lateral side of said first contact piece group with the horizontal pitch between each adjacent contact piece being coarse, wherein:

the plurality of first contact-piece holding holes are of similar size to the plurality of second contact-piece holding holes;

the plurality of first contact pieces are fitted in and held in a respective one of said first contact-piece holding holes;

the plurality of second contact pieces are fitted in and held in a respective one of said second contact-piece holding holes; and the rearward portion of said body is opened at its rear side and bottom, said body further having:

rows of vertical ribs for holding the contact pieces, said rows of vertical ribs projecting in the rearward direction from a plurality of vertical and transverse positions of the rear surface of said forward portion, each vertical rib having upper end edges;

horizontal ribs disposed on each of said vertical ribs and projecting transversely from said upper end edges of a respective vertical rib;

the rearwardly projecting distances of said row of vertical ribs and said horizontal ribs from said forward portion of said body being gradually reduced in the direction from the highest row of said vertical ribs toward the lowest row of said vertical ribs; and partitioned spaces defined by said vertical and horizontal ribs respectively communicating with the plurality of first and second contact-piece holding holes.

2. A socket-type multipolar electrical connector according to claim 1, wherein the shape of the body in front elevation is long from side to side and substantially rectangular.

3. A socket-type multipolar electrical connector according to claim 1, wherein each of the first and second contact pieces has a front end, a rearward part, a pair of guide pieces at the front end thereof and a pair of contact-piece main bodies which are raised from the rearward part thereof, and which each have a front end and extend in the forward direction, said contact-piece main bodies being provided at their front ends thereof with contacts.

4. A socket-type multipolar electrical connector according to claim 3, wherein each of the first and second contact pieces has a terminal adapted to be bent and which extends rearwardly through a narrow-width part formed at the rear end portion of said contact piece.

5. A socket-type multipolar electrical connector according to claim 3, wherein the first contact-piece holding holes and the second contact-piece holding holes are provided on the upper walls of the rear end portions thereof with engagement projections, and said engagement projections fitting between the pairs of contact-piece main bodies respectively of the contact pieces inserted and fitted in adjacent first contact-piece holding holes, and between the pairs of contact-piece main bodies respectively of the contact pieces inserted and fitted in adjacent second contact-piece holding holes.

6. A socket-type multipolar electrical connector according to claim 1, wherein said plurality of first contact pieces and second contact pieces each have rear end portions, further comprising:

a first terminal group comprising a plurality of first terminals extending downwardly from and at right angles to the rear end portions of the first contact pieces; and a second terminal group comprising a plurality of second terminals extending downwardly from and at right angles to the rear end portions of the second contact pieces, said plurality of first and second terminals forming said terminal groups being arranged in an assembly pattern similar to the assembly pattern in which said contact pieces are arranged.

7. A socket-type multipolar electrical connector according to claim 6, wherein the rearward portion of said body is opened at the rear side and bottom thereof, further comprising:

a plate-like terminal holder having terminal holding holes therein arranged in an assembly pattern identical with the assembly pattern in which said first and second terminal groups are arranged;

the terminals which form said first and second terminal groups being inserted into respective ones of said terminal holding holes; and said terminal holder being fittrd in the opening formed at the bottom of the rearward portion of said body.

8. A socket-type multipolar electrical connector according to claim 6, wherein the rearward portion of said body is opened at the rear side and bottom thereof, further comprising a shield cover comprising, in a unitary structure:

a case-like portion placed on the forward portion of said body;

an intermediate plate portion placed on the rearward portion of said body so as to surround the top and lateral sides of said rearward portion, said intermediate plate portion having integrally formed terminals which extend downwardly; and a rear surface portion for closing the opening at the rear side of said body, said rear surface portion being bent at a boundary part thereof between said rear surface portion and said intermediate plate portion, to thereby close siad opening of said body.

9. A socket-type multipolar electrical connector according to claim 8, wherein a space is formed between the case-like portion of the shield cover and the forward portion of the body on which said case-like portion is placed, and in which a shield cover of a plug-type electrical connector is adapted to be fitted, and said case-like portion has a top plate portion, inclined surfaces extending downwardly and inclined, from both transverse ends of said top plate portion, a pair of lateral plates extending downwardly from the lower ends of said inclined surfaces, and a lower plate portion extending between said lateral plates.

10. A socket-type multipolar electrical connector according to claim 9, wherein the case-like portion of the shield cover is provided in the pair of lateral plates thereof with engagement holes into and from which locking projections of the shield cover of the plug-type electrical connector are adapted to be fitted and removed.

11. A socket-type multipolar electrical connector according to claim 1, wherein said plurality of first contact pieces and second contact pieces each have rear end portions, further comprising:

a first terminal group comprising a plurality of first terminals extending downwardly from and at right angles to the rear end portions of the first contact pieces; and a second terminal group comprising a plurality of second terminals extending downwardly from and at right angles to the rear end portions of the second contact pieces, said plurality of first and second terminals forming said terminal groups being arranged in an assembly pattern similar to an assembly pattern in which said contact pieces are arranged.

12. A socket-type multipolar electrical connector according to claim 11, wherein the rearward portion of said body is opened at the rear side and bottom thereof, further comprising:

a plate-like terminal holder having terminal holding holes therein arranged in an assembly pattern identical with the assembly pattern in which said first and second terminal groups are arranged;

the terminals which form said first and second terminal groups being inserted into respective ones of said terminal holding holes; and said terminal holder being fitted into the opening formed at the bottom of the rearward portion of said body.

13. A socket-type multipolar electrical connector according to claim 9, wherein the rearward portion of said body is opened at the rear side and bottom thereof, further comprising a shield cover comprising, in a unitary structure:

a case-like portion placed on the forward portion of said body;

an intermediate plate portion placed on the rearward portion of said body so as to surround the top and lateral sides of said rearward portion, said intermediate plate portion having integrally formed terminals which extend downwardly; and a rear surface portion for closing the opening at the rear side of said body, said rear surface portion being bent at a boundary part thereof between said rear surface portion and said intermediate plate portion, to thereby close said opening of said body.

14. A socket-type multipolar electrical connector according to claim 13, wherein a space is formed between the forward portion of the body on which the case-like portion of the shield cover is placed, and in which a shield cover of a plug-type electrical connector is adapted to be fitted, and said case-like portion has a top plate portion, inclined surfaces extending downwardly and inclined, from both transverse ends of said top plate portion, a pair of lateral plates extending downwardly from the lower ends of said inclined surfaces, and a lower plate portion extending between said lateral plates.

15. A socket-type multipolar electrical connector according to claim 14, wherein the case-like portion of the shield cover is provided in the pair of lateral plates thereof with engagement holes into and from which locking projections of the shield cover of the plug-type electrical connector are adapted to be fitted and removed.

* * * * *

UNITED STATES PATENT AND TRADEMARK OFFICE

CERTIFICATE OF CORRECTION

PATENT NO. : 6,203,336 B1
DATED : March 20, 2001
INVENTOR(S) : Masahiko Nakamura It is certified that error appears in the above-identified patent and that said Letters Patent is hereby corrected as shown below:

Title page,
Item [63], the filing date "Aug. 26, 1999" should be -- Aug. 26, 1994 --.

Claim 7,
Line 12, "fittrd" should be -- fitted --.

Claim 8,
Line 16, "siad" should be -- said --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*